US007640627B2

(12) United States Patent
Lowen et al.

(10) Patent No.: US 7,640,627 B2
(45) Date of Patent: Jan. 5, 2010

(54) DOOR-STOPPING DEVICE FOR MOTOR VEHICLES

(75) Inventors: Jakob Lowen, Gummersbach (DE); Gyala Kumor, Budapest (HU)

(73) Assignee: ISE Innomotive Systems Europe GmbH, Bergeneustadt (DE)

( * ) Notice: Subject to any disclaimer, the term of this patent is extended or adjusted under 35 U.S.C. 154(b) by 515 days.

(21) Appl. No.: 11/476,522

(22) Filed: Jun. 28, 2006

(65) Prior Publication Data

US 2007/0012687 A1 Jan. 18, 2007

(30) Foreign Application Priority Data

Jun. 29, 2005 (DE) ..... 10 2005 030 699

(51) Int. Cl.
*E05C 17/22* (2006.01)

(52) U.S. Cl. ..... 16/86 C; 16/334

(58) Field of Classification Search ..... 16/86 C, 16/86 B, 82, 334, 332; 292/262, 265, 269, 292/273, 275, 278, DIG. 15; 296/146.11, 296/146.12

See application file for complete search history.

(56) References Cited

U.S. PATENT DOCUMENTS

| | | | | |
|---|---|---|---|---|
| 2,268,977 | A * | 1/1942 | Westrope | 16/86 C |
| 5,173,991 | A * | 12/1992 | Carswell | 16/86 A |
| 5,474,344 | A * | 12/1995 | Lee | 292/262 |
| 6,446,305 | B1 * | 9/2002 | Kneeland | 16/82 |
| 6,813,811 | B2 * | 11/2004 | Matsuki et al. | 16/86 B |
| 6,871,382 | B2 * | 3/2005 | Murayama et al. | 16/82 |
| 7,143,473 | B2 * | 12/2006 | Matsuki | 16/86 C |

FOREIGN PATENT DOCUMENTS

| | | | |
|---|---|---|---|
| DE | 3207922 | C1 * | 10/1983 |
| DE | 4005285 | A1 * | 8/1991 |
| DE | 297 17 283 | | 10/1997 |
| DE | 10013583 | A1 * | 9/2001 |
| DE | 201 20 271 | | 12/2001 |
| DE | 103 51 061 | | 5/2004 |
| DE | 103 02 549 | | 8/2004 |
| DE | 10 2004 015 793 | | 4/2006 |
| JP | 07331944 | A * | 12/1995 |
| JP | 09279925 | A * | 10/1997 |
| JP | 10046897 | A * | 2/1998 |

* cited by examiner

*Primary Examiner*—Chuck Y. Mah
(74) *Attorney, Agent, or Firm*—Bachman & LaPointe, P.C.

(57) ABSTRACT

A door-stopping device for motor vehicles, includes a door holder bar, a support housing including a passage for the door holder bar to pass through, and a locking unit disposed in the support housing, which includes two pivotally mounted locking levers. Each locking lever is pre-tensioned by a spring element towards each other and towards the door holder bar. Each locking lever comprises a locking element. The locking elements bear on mutually opposite sides against the door holder bar and are adapted to engage with the locking grooves on the door holder bar. For the door-stopping device to present diverse possibilities of design, to be manufactured in a cost-effective manner and to occupy only little space, the spring elements are arranged substantially parallel to the door holder bar.

12 Claims, 9 Drawing Sheets

DOOR-STOPPING DEVICE FOR MOTOR VEHICLES

BACKGROUND (1) Field of the Invention

The invention relates to a door-stopping device for motor vehicles comprising a door holder bar, a support housing with a passage for the door holder bar to pass through and a locking unit provided in the support housing, comprising two pivotally mounted locking levers, each pre-tensioned by a spring element towards each other and towards the door holder bar, each locking lever comprising a locking element, the locking elements bearing on mutually opposite sides against the door holder bar and being adapted to engage with the locking grooves on the door holder bar.

(2) Prior Art

A door-stopping device is known from DE 201 20 271 U1, wherein a door holder bar, provided with locking grooves, is arranged pivotally on a vehicle body on the one hand, and in a displaceable manner in the support housing fitted to the vehicle door on the other hand. When the vehicle door is pivoted, a lateral face of the door holder bar provided with the locking grooves, slides from a rigid locking cam of the locking unit and, as a result, locks the vehicle door in predetermined opening positions. Opposite to the locking grooves, on the essentially plane side of the door holder bar, the latter is pressed towards the locking element by a spring-loaded cam.

This door-stopping device has the drawback that its function absolutely requires that the locking grooves must be oriented parallel to the pivoting axis of the door holder bar associated with the vehicle body, since a pivoting ability of the door holder bar is the prerequisite for the operation of the locking unit. This results in considerable structural limitations in the design of the stopping device as well as the associated components, i.e. the vehicle door and the fixing regions of the door holder bar on the vehicle body.

A door-stopping device of the type as set out in the opening paragraph is furthermore known from DE 297 17 283 U1. The locking levers are pre-tensioned by spring elements, whose ends opposite to the locking levers are supported inside the housing. In order to ensure the required support and in order to prevent deformations as a result of the supporting forces, the door-stopping device must be designed accordingly in the supporting region. This, however, entails considerable structural limitations as well as disadvantages with regard to weight.

SUMMARY OF THE INVENTION

It is the object of the invention to provide a door-stopping device, which offers multiple possibilities of configuration, can be manufactured in a cost-effective manner and occupies only little space, while ensuring at the same time reliable stopping of the vehicle door associated with the door-stopping device.

The object according to the invention is attained by a door-stopping device with the characteristics of claim 1. Advantageous further developments of the invention are stated in the dependent claims.

The door-stopping device according to the invention is characterised in that the spring elements are arranged substantially parallel to the door holder bar.

The pivotal mounting of the locking levers co-acting with the door holder bar makes it possible to dispose the locking unit in any desired manner in the support housing independently of the pivoting axis of the door holder bar associated with the vehicle body. It is possible to provide the locking levers in such a manner that their pivoting axes extend parallel to the pivoting axis of the door holder bar associated with the vehicle body. Alternatively, the locking levers may also be so arranged that their pivoting axes extend normal to the pivoting axis of the door holder bar associated with the vehicle-body. It is important in this context that the locking elements interacting with the locking grooves are movable in relation to the door holder bar, so that a relative movement of the door holder bar in relation to the locking elements is not necessary for the function of the door-stopping device.

The design according to the invention of the door-stopping device therefore offers great freedom of design when adapted to the respective vehicles and permits the minimisation of the space requirements.

Minimising the space requirements is further aided by using the two separate spring elements, each of which pre-tensions a locking lever in the direction of the door holder bar. As a result, a complicated construction increasing space requirements, in which both locking levers are loaded by a single spring element, may be dispensed with.

A further advantage of the design according to the invention resides in that—in the event of the pivoting axes of the locking levers extending normal to the pivoting axis of the holding bar associated with the vehicle body—the door holder bar is secured in its position formed by a plane normal to the pivoting axis of the door holder bar associated with the vehicle body, so that movements possibly damaging the bearings are reliably avoided.

The disposition of the springs according to the invention makes it possible to configure the door-stopping device in a particularly small size, the space required for accommodating the locking levers already sufficing to provide suitable spring elements. In addition, the arrangement of the spring elements, essentially parallel to the door bar, offers the advantage that the ends of the spring elements opposite the locking elements are supported in a region of a housing of the door-stopping device, which corresponds to the region, which, in the position of installation of the door-stopping device, bears against the sheet metal behind it, for example the door panel. This permits a less solidly designed housing than is the case with the springs known in the state of the art, which are arranged normal to the door holder bar, as behind them, there is, for example, the door panel. The springs are aligned in the effective direction of a solid screw connection between housing and door panel. The door-stopping device may be manufactured to have a particularly low weight, is cost-effective and is small.

The spring elements may, in principle, be designed in any desired manner. According to an advantageous embodiment of the invention, the elastic force of the spring elements may, however, be adjustable. This may take place by a regulating screw, which may be screwed into the support housing and from which the spring elements derives its support.

The adjustability of the elastic force makes it possible to compensate for possibly occurring material fatigue of the spring, so that a possibly required replacement of parts of the door-stopping device or the entire door-stopping device may be dispensed with.

The arrangement, orientation and design of the locking grooves on the door holder bar is, in principle, freely selectable. Apart from an arrangement, normally parallel to a pivoting axis of the door, of the locking grooves, as a rule, symmetrical in cross-section, it is also possible to dispose the locking grooves normal or at any desired angle to the pivoting axis. The individual locking grooves may in this context be identical or, according to a particularly advantageous further development of the invention, deviate from one another, so that in each case different operating forces are required in order to pivot the door. According to this further development, the possibilities of adaptation of the door-stopping device according to the invention are enhanced in a complementary manner.

According to an advantageous embodiment of the invention, one or more locking grooves present an asymmetrical cross-section. This design extends the possibilities of design of the door-stopping device in a complementary manner, the asymmetrical configuration permitting the determination of different forces for opening and closing the door from the respective locking position.

The advantageous designs of the locking grooves permit in particular to adapt the door-stopping device according to the invention to the most diverse structural specifications.

According to a particularly advantageous further development of the invention, the locking elements comprise, at least in portions thereof, a circular cross-section while the locking grooves present a correspondingly arcuate shape. This embodiment of the invention ensures reliable stopping of the vehicle door in the opening positions of a vehicle door connected to the door-stopping device, predetermined by the arrangement of the locking grooves. At the same time, this design allows the respective locking positions to be left without unreasonably high force expenditure, it being possible, by means of the configuration of the locking grooves, to constructively determine the respective force expenditure and to adapt the latter to the respective vehicle.

Particularly advantageously, the locking elements are formed as an integral part of the locking levers. As a result, the number of required structural components for the door-stopping device and, consequently, the manufacturing costs may additionally be reduced. Alternatively, according to a further development of the invention, the locking element is formed by a roll provided rotatably on the locking lever. This embodiment additionally increases the functional safety and comfort when actuating the door-stopping device.

For manufacturing the door-stopping device, any material meeting the required mechanical properties may, in principle, be used. However, according to an advantageous embodiment of the invention, the locking levers and/or the locking elements are made of a plastics material having good sliding properties. The use of a suitable plastics material makes it possible, in comparison with door-stopping devices made from metallic materials, to additionally reduce the weight. The locking elements and/or locking levers made from plastics material having good sliding properties, ensure in this context that the occurring phenomena of wear and tear do not impair the function of the door-stopping device.

For additional weight reduction, according to a further embodiment of the invention, the door holder bar is made from a metal bar coated with plastics while the support housing is manufactured from fibre-reinforced plastics, advantageously glass fibre-reinforced plastics. This combination is characterised by its high strength and low weight. In addition, by advantageously coating the metal bar with plastics, taking into account the coefficients of friction of the metal may be dispensed with when selecting the material of the door holder bar.

The arrangement of the locking grooves as well as their number on the door holder bar is determined by the locking positions to be provided and may, in principle, be optionally selected. In the event of a vertically opposite arrangement of the locking grooves on the door holder bar, a particularly high locking moment is attained even with slight elastic forces, so that the selected spring elements may be designed particularly small.

Alternatively, it is however possible to arrange the locking grooves on the mutually opposite sides of the door holder bar in such a manner that the locking elements arranged opposite engage alternatingly with the locking grooves. This further development of the invention makes it possible to increase the number of locking positions in the pivoting angle region of the vehicle door. Possibly occurring instabilities of the locking arrangement may be countered by stronger spring elements or a different configuration of the locking grooves.

In principle, the spring elements may in this context be freely selected. However, according to a particularly advantageous embodiment of the invention, cylindrical coil compression springs are used to serve as spring elements. These are characterised by their high reliability and low cost.

According to a particularly advantageous embodiment of the invention, the door holder bar is designed, on the one hand, to be fixed to a vehicle body in an articulated manner and, on the other hand, comprises a stop device, a damping element being provided on the side of the stop device facing the support housing. This embodiment of the invention enhances the comfort of the door-stopping device in a complementary manner, the opening movement being damped when the limit stop is reached, i.e. when the maximum opening angle of the door is attained, resulting in the door not hitting the limit stop at full impact.

BRIEF DESCRIPTION OF THE DRAWINGS

Embodiments of the invention are elucidated in what follows with reference to the drawings. There is shown in.

DETAILED DESCRIPTION OF THE PREFERRED EMBODIMENTS

Figure 1:
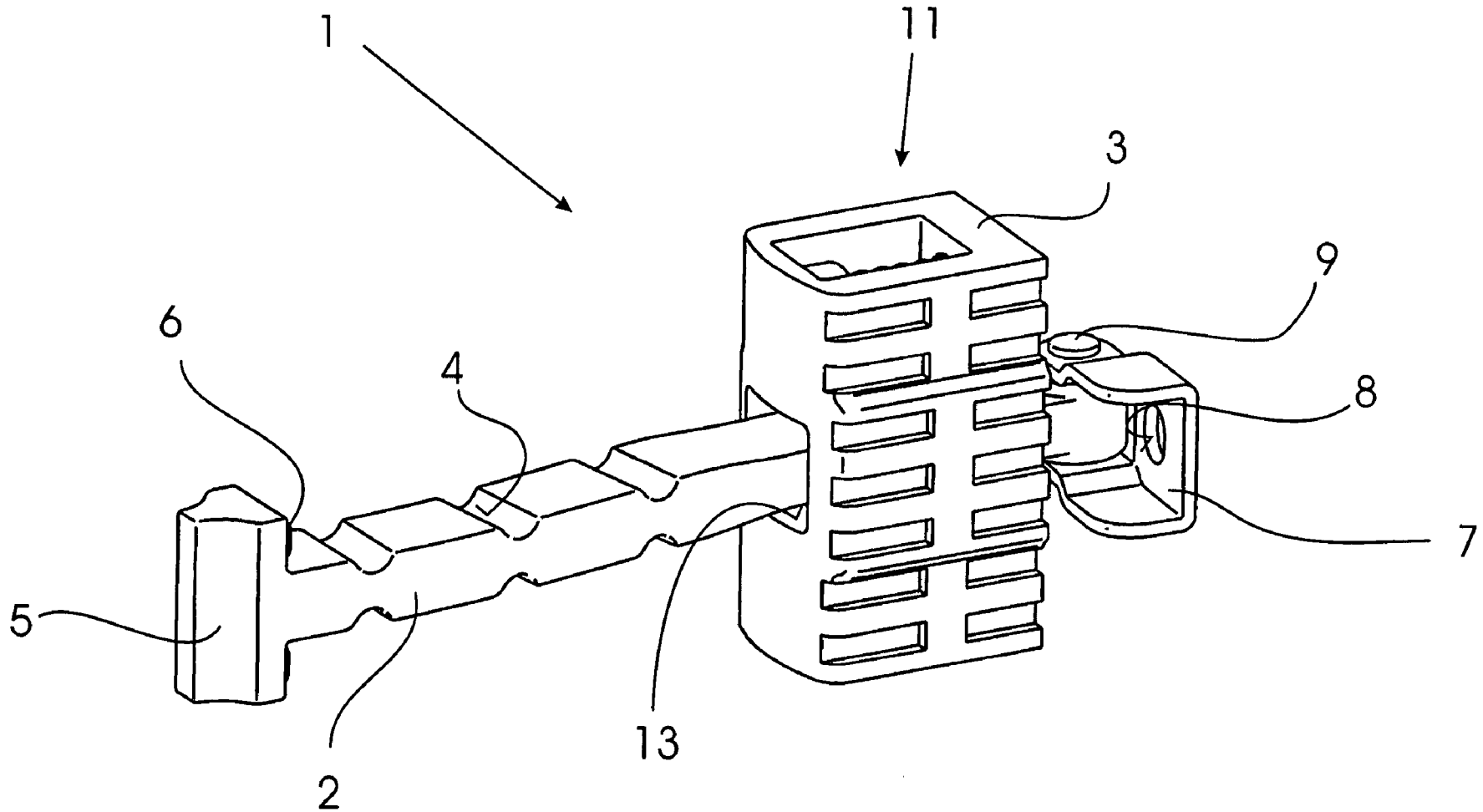
FIG. 1 a perspective view of a first embodiment of a door-stopping device.

FIG. 1 shows a first embodiment of a door-stopping device 1 made predominantly of plastics.

A door holder bar 2 of the door-stopping device 1, formed by a metal rod coated with plastics, is, on the one hand, connected in an articulated manner to a pillar bracket 7 by a bolt 9. The door holder bar 2 may be fitted pivotally to a vehicle body, not shown here, by way of the pillar bracket 7, comprising an aperture 8 for receiving a fastening screw, not shown here. The door holder bar 2 is disposed in a passage 13 of a support housing 3 which may be fitted to a vehicle door, likewise not shown here. Should the vehicle door be pivoted in relation to the vehicle body, the support housing 3 fitted to the vehicle door is displaced relatively in relation to the door holder bar 2, in which case the door holder bar 2, in order to provide a maximum opening angle of the vehicle door, comprises a stopping member 5 at its end facing the vehicle door, which stopping member 5, at its side facing the support housing 3, comprises a damping body 6 for absorbing the limit stop.

Figure 2:
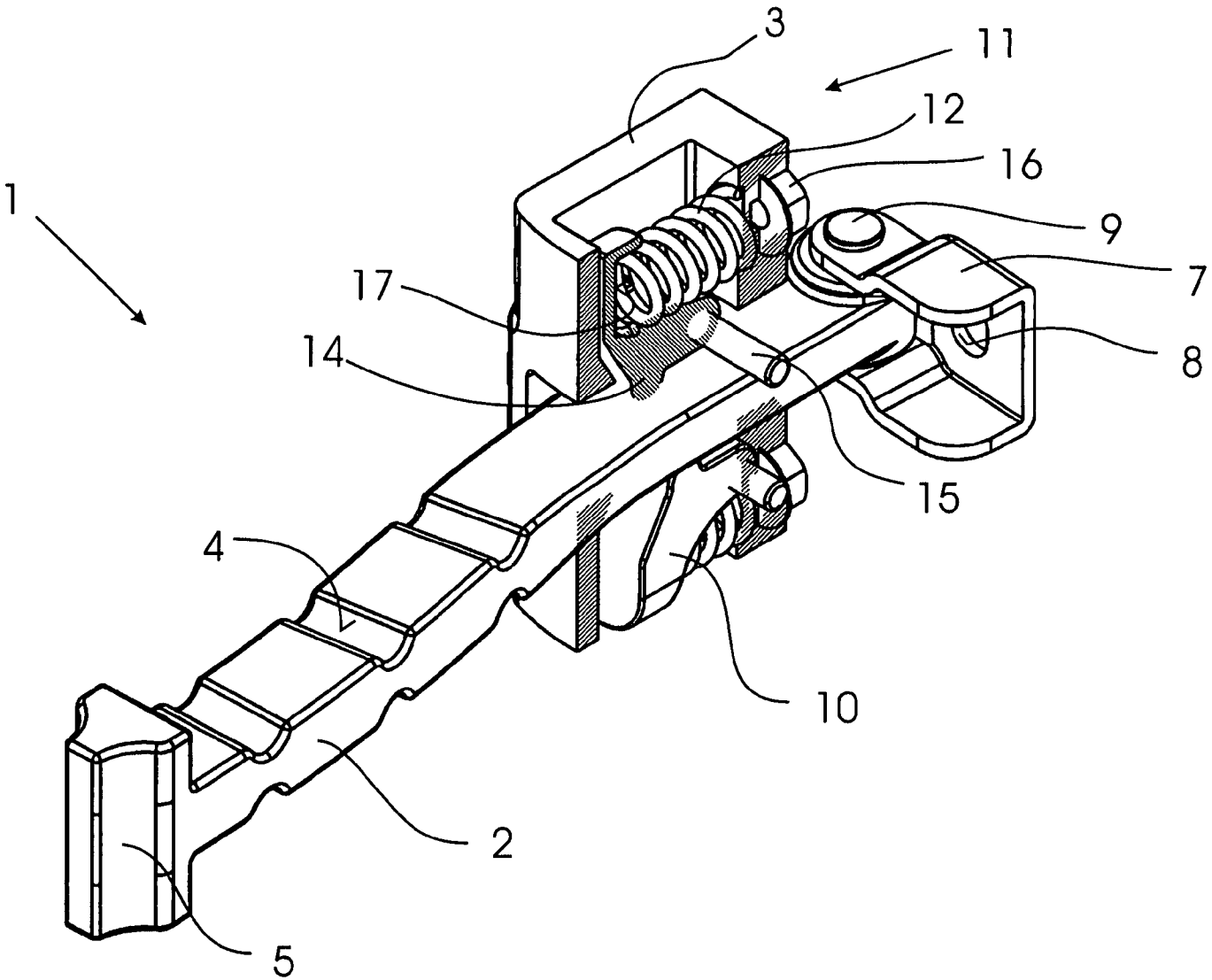
FIG. 2 a perspective illustration of the door-stopping device according to FIG. 1, partially in section.
Figure 3:
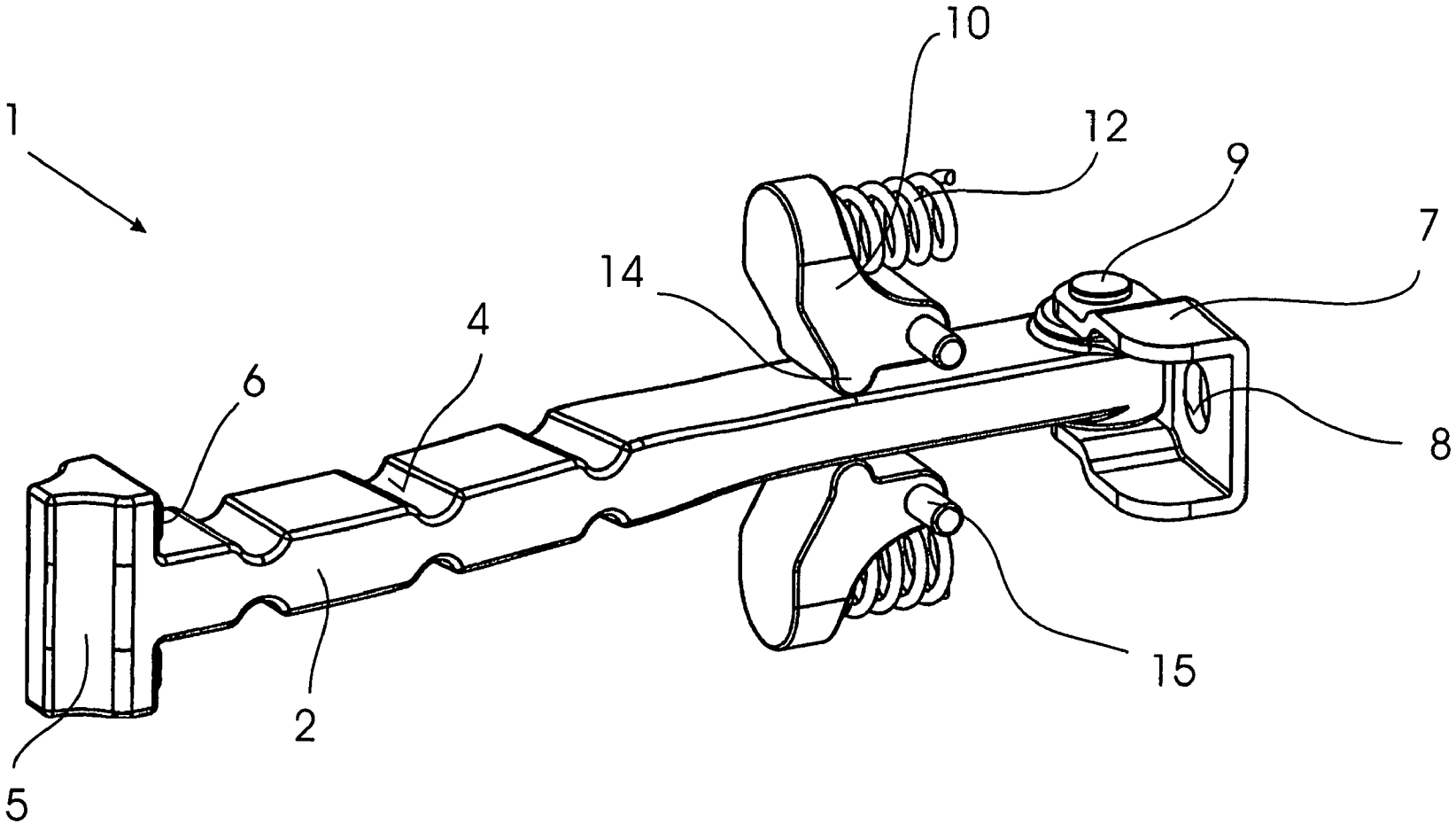
FIG. 3 a perspective illustration of the door-stopping device according to FIG. 1 without support housing.
Figure 4:
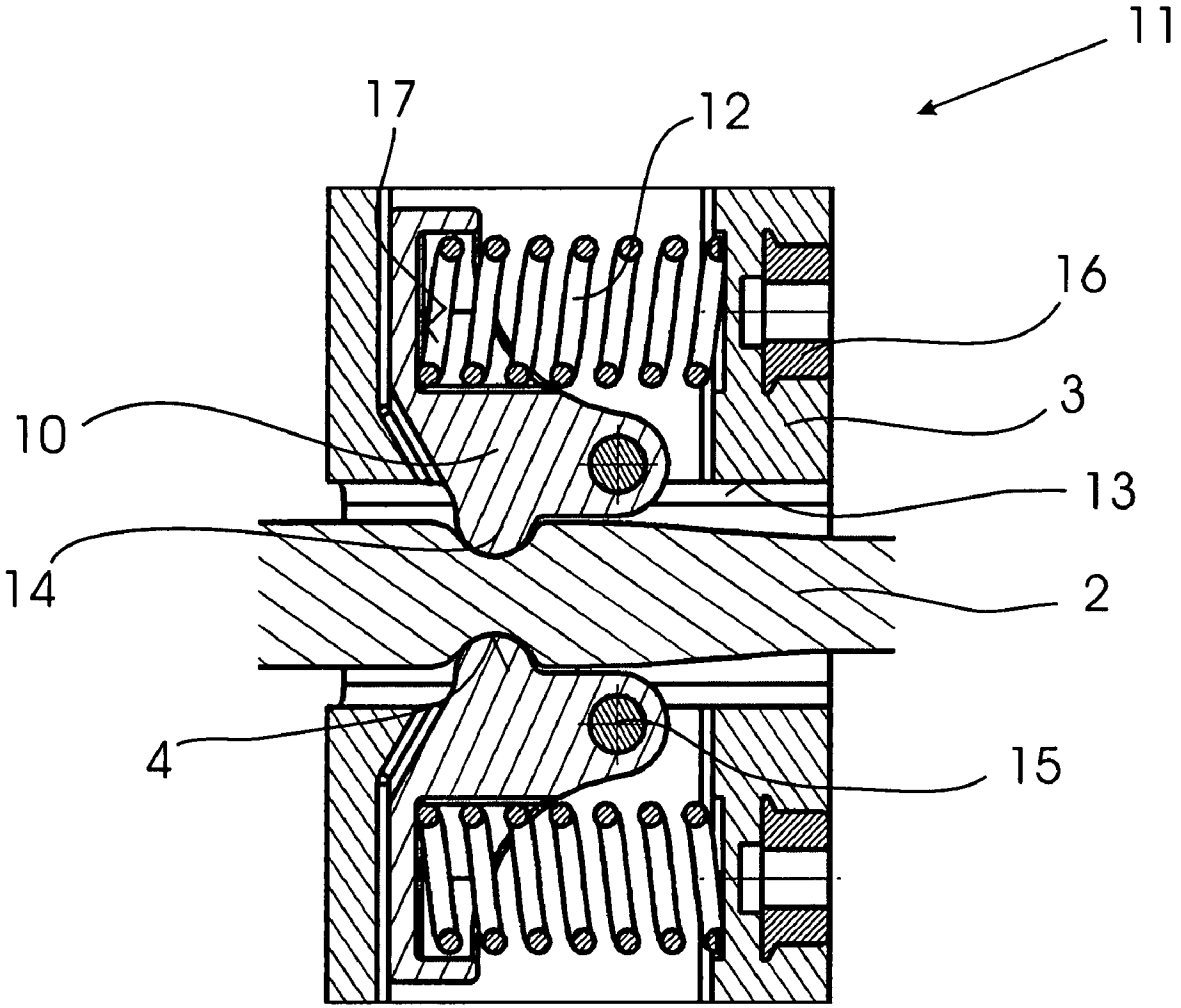
FIG. 4 a sectionalised view of the support housing of the stopping device shown in FIG. 1.
Figure 5:
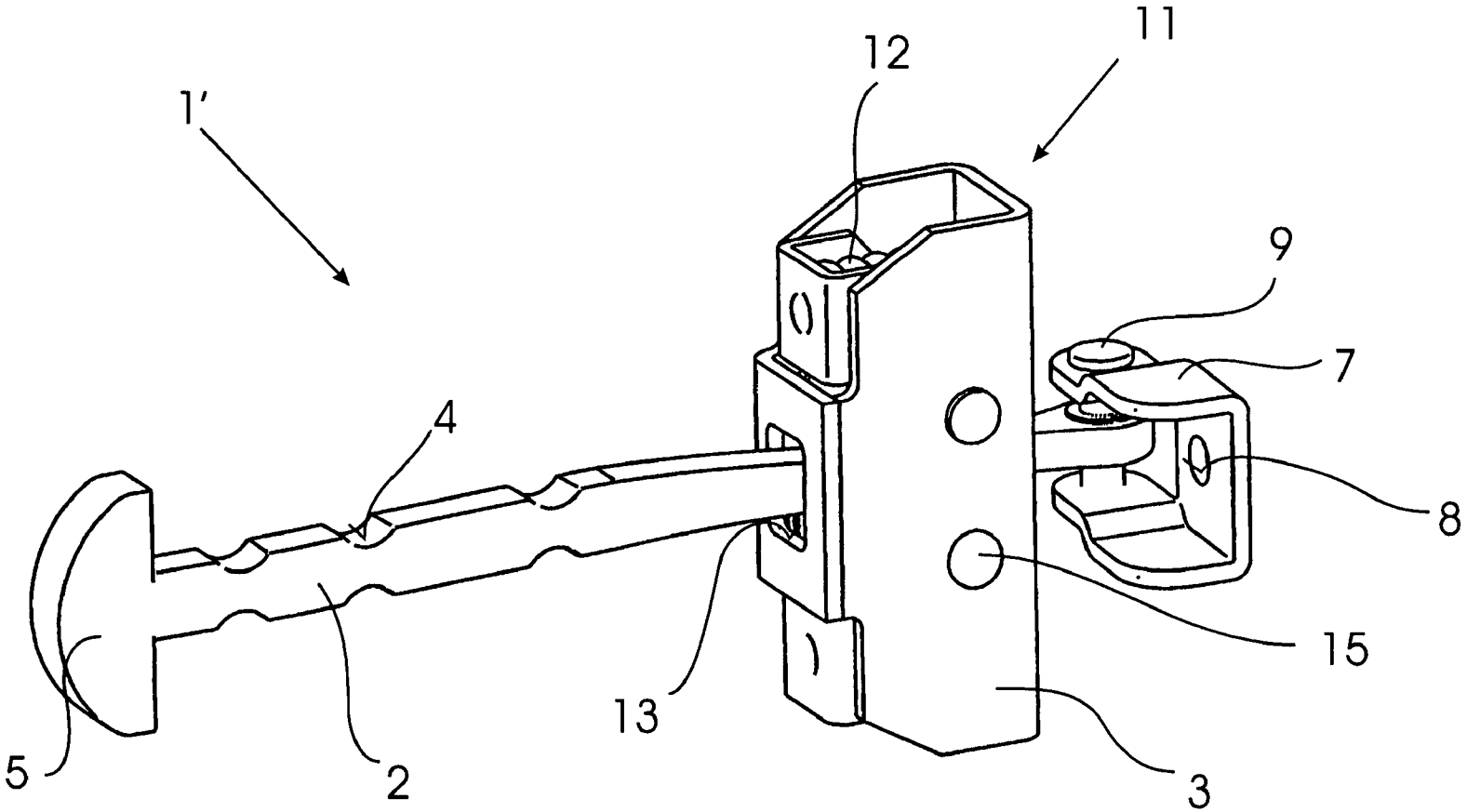
FIG. 5 a perspective view of a second embodiment of a door-stopping device.
Figure 6:
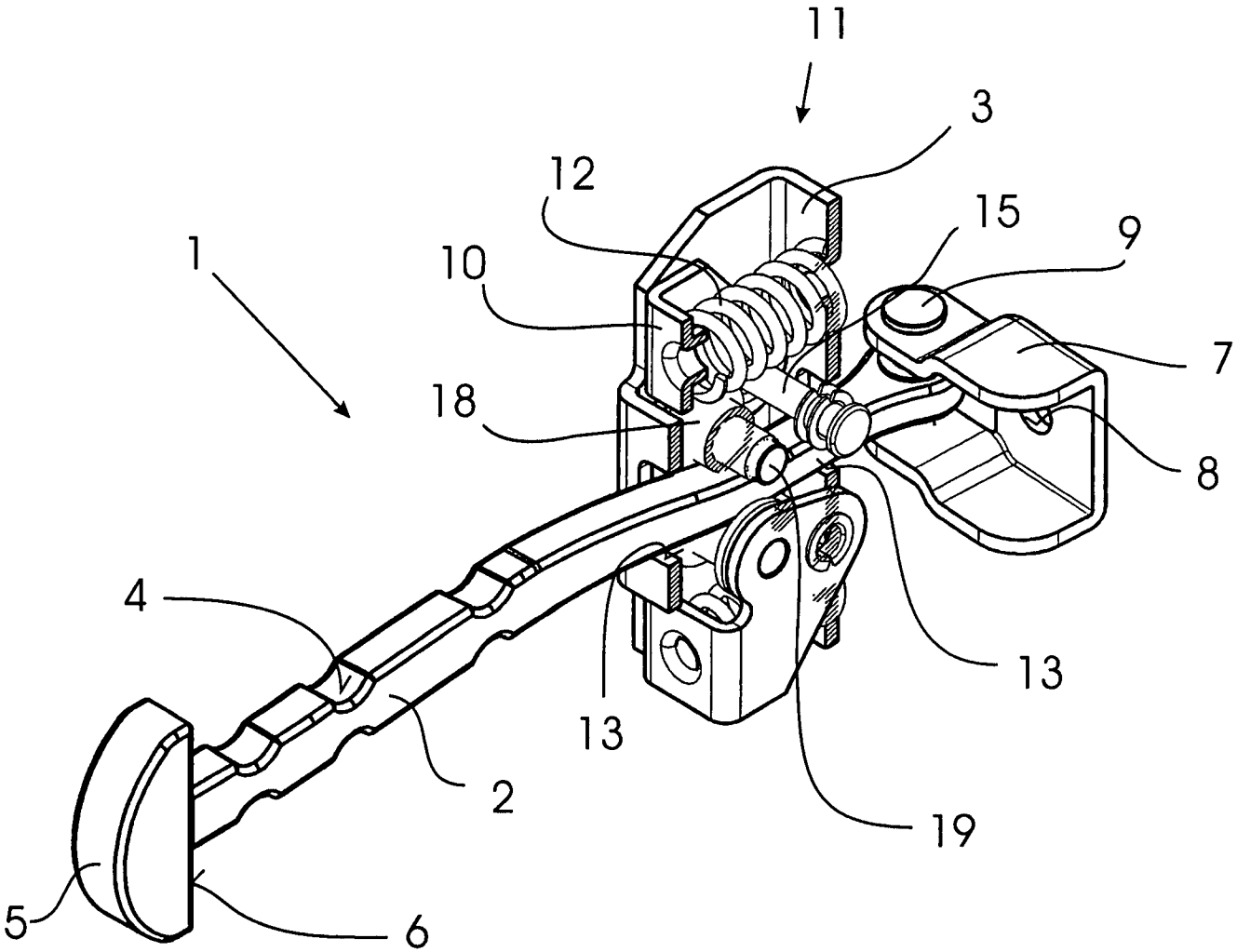
FIG. 6 a perspective illustration of the door-stopping device according to FIG. 5, partially in section.
Figure 7:
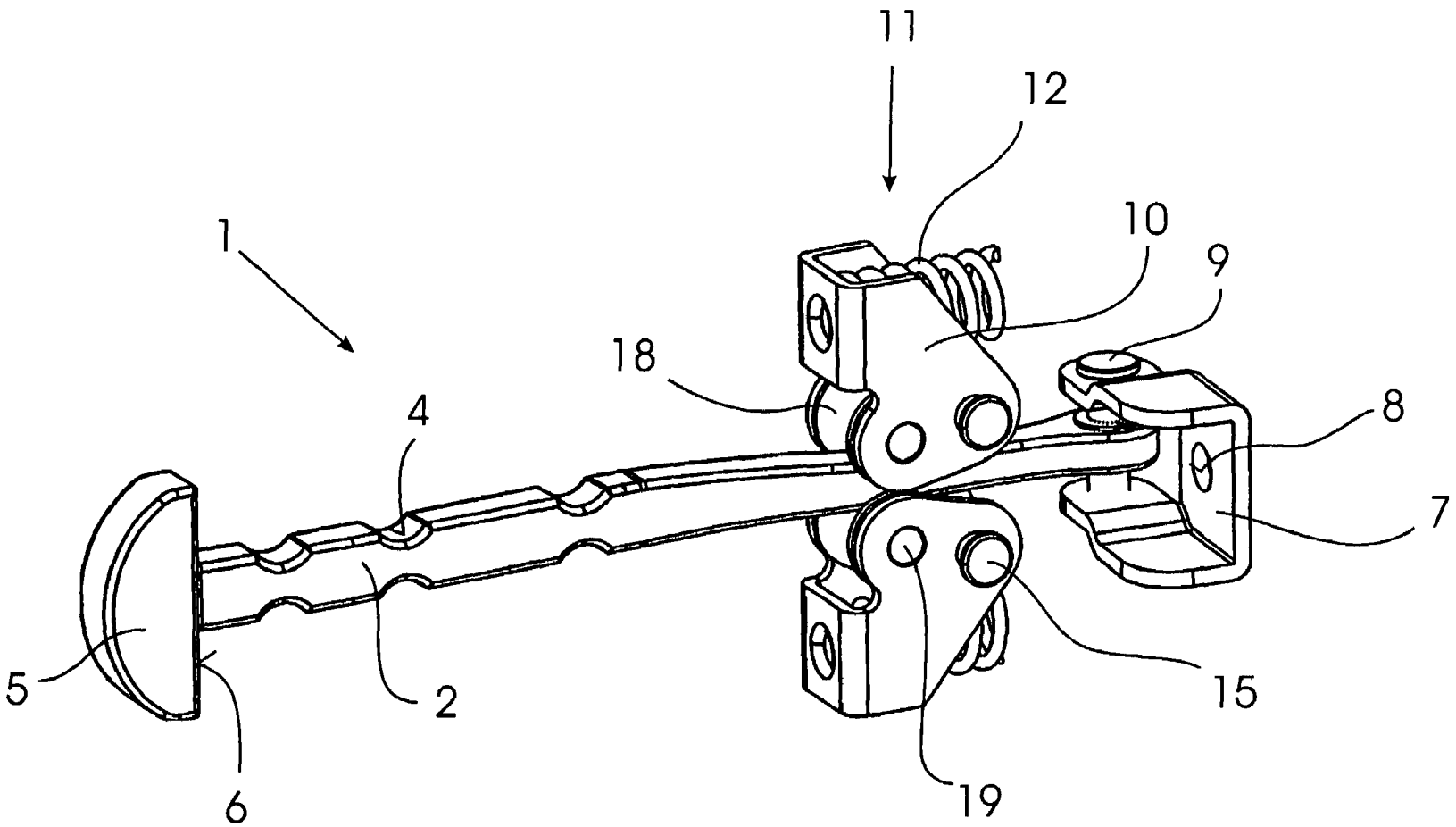
FIG. 7 a perspective illustration of the door-stopping device according to FIG. 5 without support housing.
Figure 8:
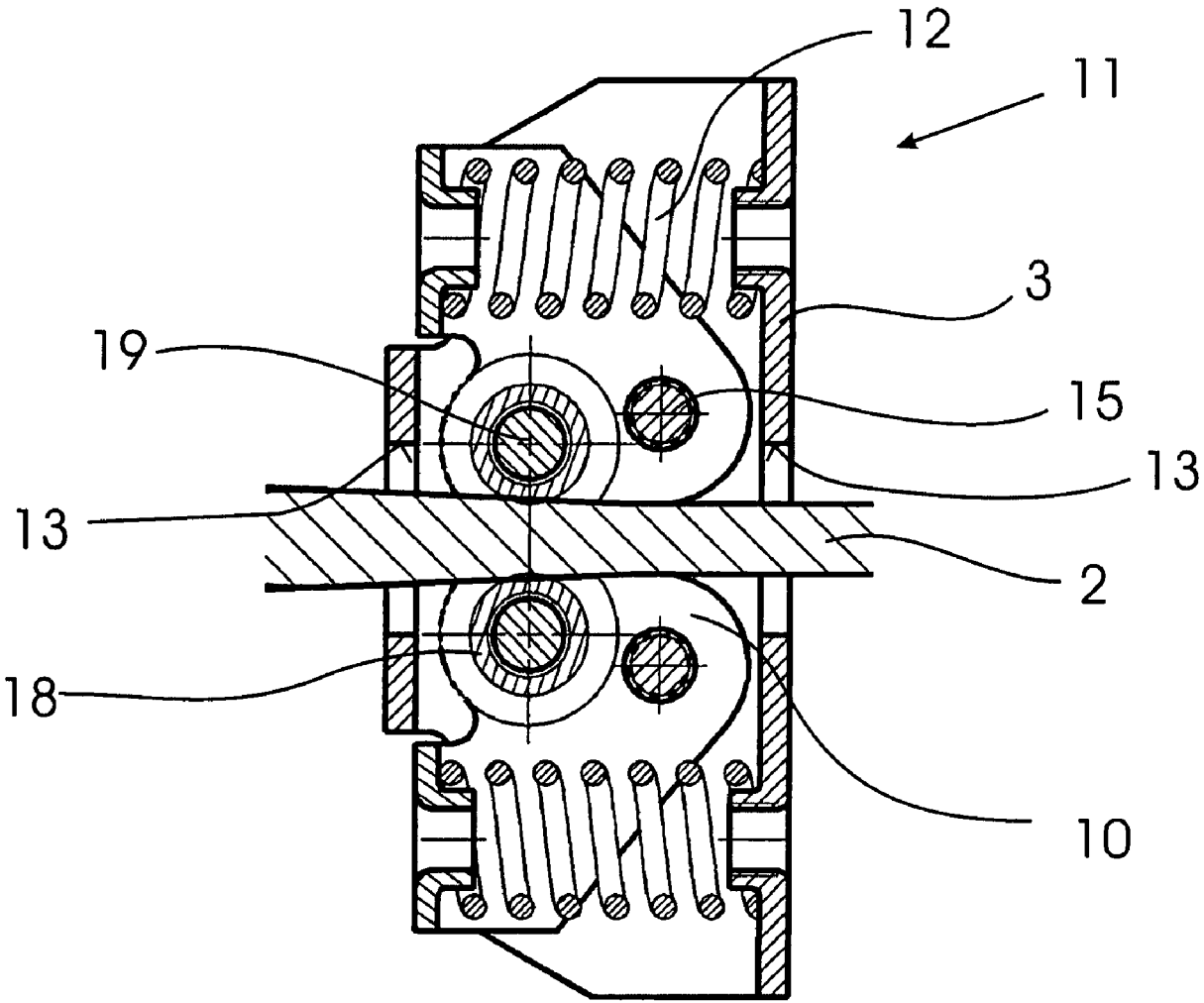
FIG. 8 a sectionalised view of the support housing of the door-stopping device according to FIG. 5.

At its surfaces, which, in the position of installation, form an upper side and an underside, the door holder bar 2 comprises locking grooves 4, interacting with locking elements 14 of a locking unit 11 provided in the support housing 3 (cf. FIGS. 2-4).

The locking unit 11 is formed by two locking levers 10 mounted pivotally in the support housing 3 and loaded by coil compression springs 12, comprising in their region of contact with the door holder bar semi-circular locking elements 14, which are designed to correspond to the locking grooves 4.

The locking levers 10 are mounted on hinge pins 15 fitted in the support housing 3, extending normal to the pivoting axis of the vehicle door predetermined by the articulated bolt 9. The coil compression springs 12 derive support, on the one hand, from a bearing surface 17 of the locking levers 10 and, on the other hand, from an adjusting screw 16, adapted to be screwed into the support housing 3 and determining the elastic force, and pre-tension the locking levers 10 towards the upper- and undersides of the door holder bar 2.

In the opening positions of the vehicle door, determined by the arrangement of the locking grooves 4, the locking elements 14 engage in the locking grooves 4 and stop the vehicle door. The door holder bar 2 is formed by a metal rod coated with plastics while the support housing 3 is formed of glass-fibre reinforced plastics.

A further embodiment of a door-stopping device 1' is shown in FIGS. 5-8. The components of the door-stopping device 1' shown there, are made of steel.

The functional mode of the door-stopping device 1' corresponds to the functional mode of the door-stopping device 1 shown in FIGS. 1-4. Apart from using steel instead of plastics, the door-stopping device 1', contrary to the door-stopping device 1, comprises rolls 18, fastened to the locking levers 10, mounted rotatably on the mounting bolts 19 fitted in the support housing 3'. The radius of the roll 18, preferably made of plastics, presents an essentially arcuate orientation, corresponding to the locking grooves 4.

Figure 9:
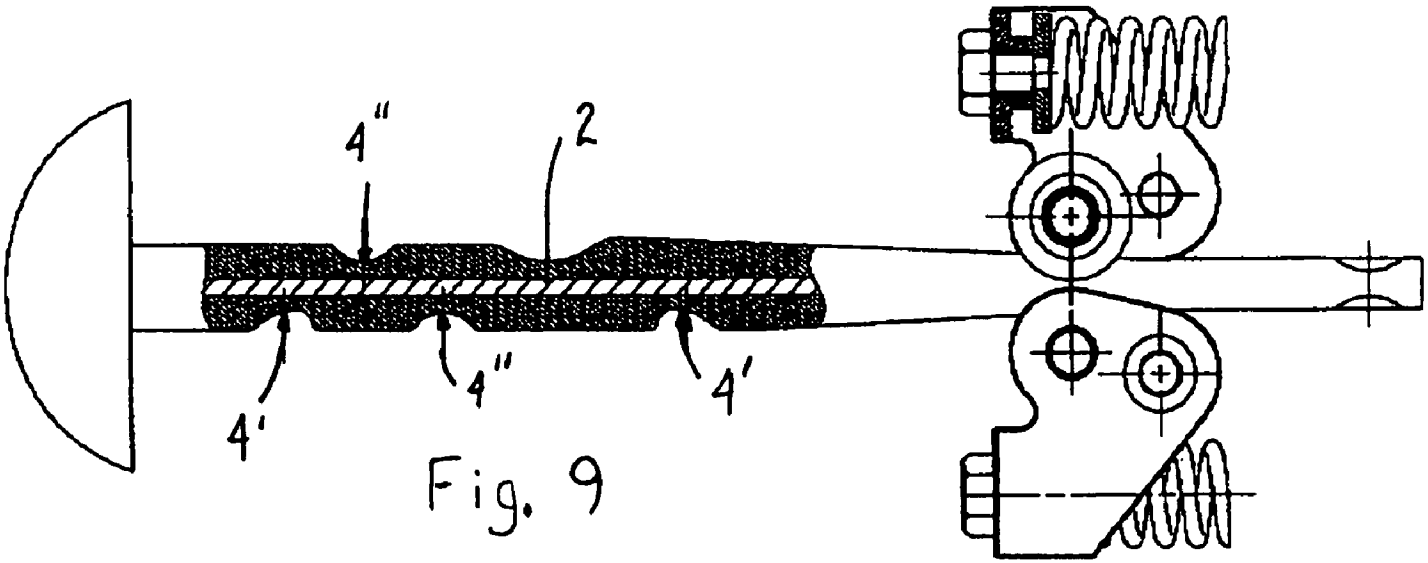
FIG. 9 is a sectionalized view of the door holding bar showing different groove configurations.

FIG. 9 shows a door holder bar 2 having a different cross section locking grooves with at least one of the locking grooves 4' having an asymmetrical cross-section, and at least one of the locking grooves 4" having an arcuate shape.

Figure 10:
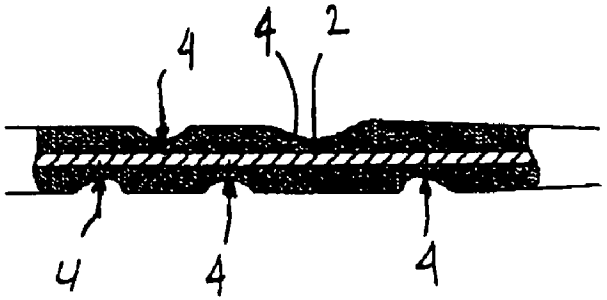
FIG. 10 is a sectionalized view of the door holding bar showing alternatingly arranged grooves.

FIG. 10 shows a door holder bar 2 having offset locking grooves 4 which may be alternatingly engaged by the locking elements 14.

The invention claimed is:

1. Door-stopping deice for motor vehicles, including:

a door holding bar;

a support housing including a passage for the door holder bar to pass through; and a locking unit disposed in the support housing, which includes two pivotally mounted locking levers, each of said locking levers being pre-tensioned by an elongated spring element towards the door holding bar, each said locking lever comprising a locking element, each locking element bearing on mutually opposite sides against the door holder bar and being adapted to engage with locking grooves formed on a surface of the door holder bar, wherein each of the spring elements is arranged substantially parallel to said surface of the door holder bar.

2. Door-stopping device according to claim 1, wherein an elastic force applied by each of the spring elements is adjustable by an adjusting means.

3. Door-stopping device according to claim 1, wherein the spring elements are formed by cylindrical coil compression springs.

4. Door-stopping device according to claim 1, wherein at least one of the locking grooves presents an asymmetrical cross-section.

5. Door-stopping device according to claim 1, wherein the locking grooves have different cross-sections.

6. Door-stopping device according to claim 1, wherein the locking elements present a circular cross-section, at least in portions thereof, and the locking grooves present a correspondingly arcuate shape.

7. Door-stopping device according to claim 1, wherein the locking elements form an integral part of the locking levers.

8. Door-stopping device according to claim 1, wherein at least one of the locking elements is formed by a roll provided rotatably on at least one of the locking levers.

9. Door-stopping device according to claim 1, wherein at least one of the locking levers and the locking elements are made of plastics having good sliding properties.

10. Door-stopping device according to claim 1, wherein the door holder bar is formed by a metal bar coated with plastics and the support housing is made of fiber-reinforced plastics.

11. Door-stopping device according to claim 1, wherein the locking grooves are arranged on opposite sides of the door holder bar and the locking elements being arranged on opposite sides of the door holder bar so as to alternatingly engage the locking grooves.

12. Door-stopping device according to claim 1, wherein the door holder bar is configured on one end for articulated fitting to a vehicle body and, on the other end, comprises a stopping member, and a damping element being provided on a side of the stopping member facing the support housing.

* * * * *

UNITED STATES PATENT AND TRADEMARK OFFICE

CERTIFICATE OF CORRECTION

PATENT NO. : 7,640,627 B2
APPLICATION NO. : 11/476522
DATED : January 5, 2010
INVENTOR(S) : Jakob Lowen et al.

It is certified that error appears in the above-identified patent and that said Letters Patent is hereby corrected as shown below:

Column 6, Claim 1, Line 1 should be amended as follows: delete "deice" and insert --device--.

Signed and Sealed this

Twenty-fifth Day of May, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,640,627 B2
APPLICATION NO. : 11/476522
DATED : January 5, 2010
INVENTOR(S) : Jakob Lowen et al.

It is certified that error appears in the above-identified patent and that said Letters Patent is hereby corrected as shown below:

Column 6, Claim 1, Line 2 should be amended as follows: delete "deice" and insert --device--.

This certificate supersedes the Certificate of Correction issued May 25, 2010.

Signed and Sealed this

Twenty-second Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,640,627 B2
APPLICATION NO. : 11/476522
DATED : January 5, 2010
INVENTOR(S) : Lowen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 681 days.

Signed and Sealed this

Twenty-first Day of December, 2010

David J. Kappos

David J. Kappos
*Director of the United States Patent and Trademark Office*